US006640083B2

(12) United States Patent
Conard-White et al.

(10) Patent No.: US 6,640,083 B2
(45) Date of Patent: Oct. 28, 2003

(54) INTERMEDIATE TRANSPARENT DOCUMENT HOLDER COVER FOR PHOTOCOPYING MACHINE PLATEN

(75) Inventors: Sally A. Conard-White, Rochester, NY (US); Deborah G. AuClair, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/046,053

(22) Filed: Jan. 15, 2002

(65) Prior Publication Data

US 2003/0133730 A1 Jul. 17, 2003

(51) Int. Cl.[7] ..... G03G 15/00

(52) U.S. Cl. ..... 399/377; 355/75; 399/380

(58) Field of Search ..... 399/377, 379, 399/380; 355/75

(56) References Cited

U.S. PATENT DOCUMENTS

| | | | | | |
|---|---|---|---|---|---|
| 4,905,045 | A | * | 2/1990 | Sasaki et al. | 399/380 |
| 5,574,542 | A | * | 11/1996 | Brook, III | 399/380 |
| 6,263,184 | B1 | * | 7/2001 | Diederiks, Jr. | 399/377 |
| 6,320,650 | B1 | * | 11/2001 | Fredlund et al. | 355/75 |

* cited by examiner

*Primary Examiner*—William J. Royer
(74) *Attorney, Agent, or Firm*—Philip T. Virga

(57) ABSTRACT

An intermediate platen cover is provided between a platen and a platen cover of a photocopying machine to prevent displacement of a document on the platen. The intermediate platen cover is transparent to allow the user to see placement of the document and to not interfere with the background lower surface of the platen cover during photocopying.

13 Claims, 6 Drawing Sheets

FIG. 1
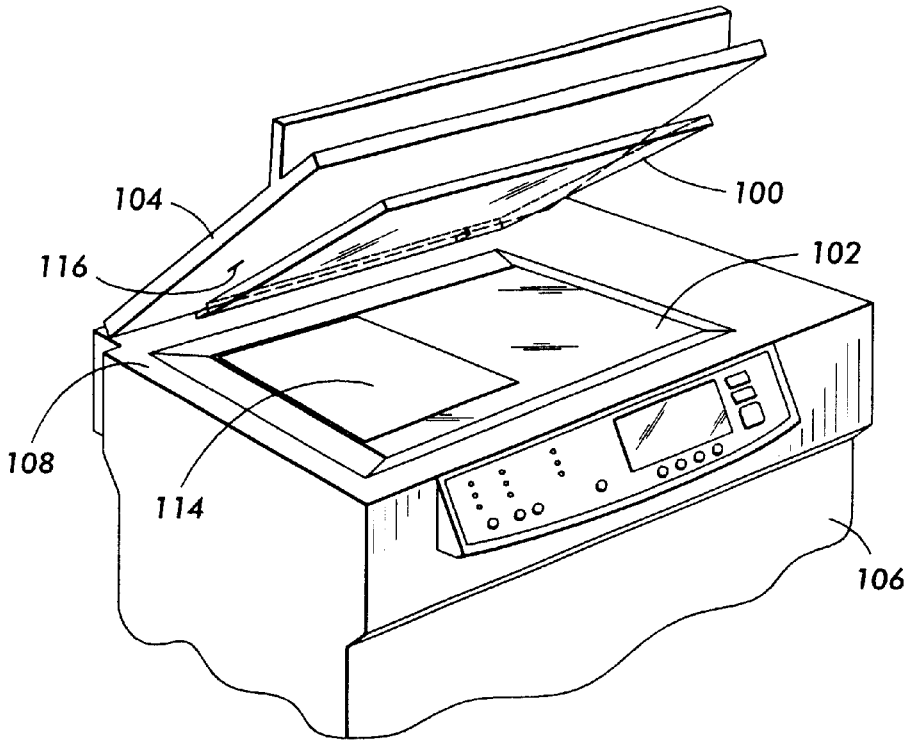
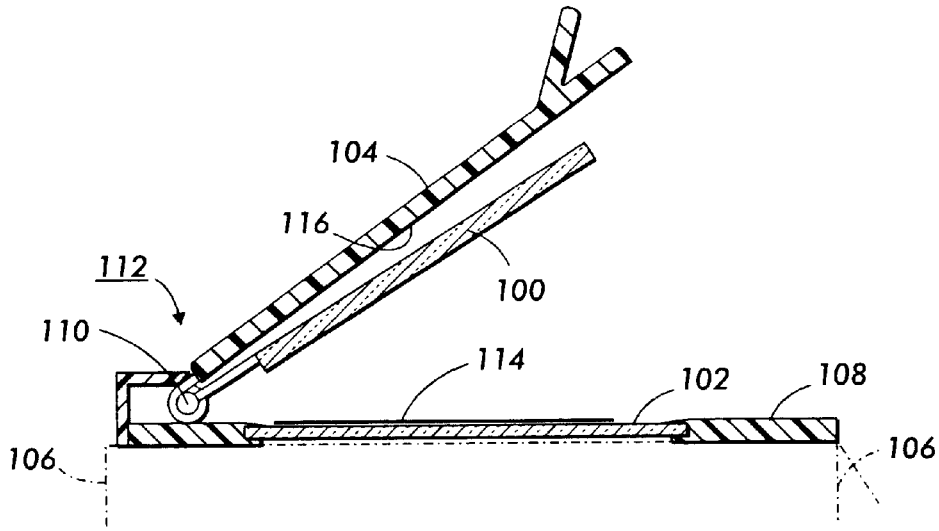
FIG. 2

FIG. 5
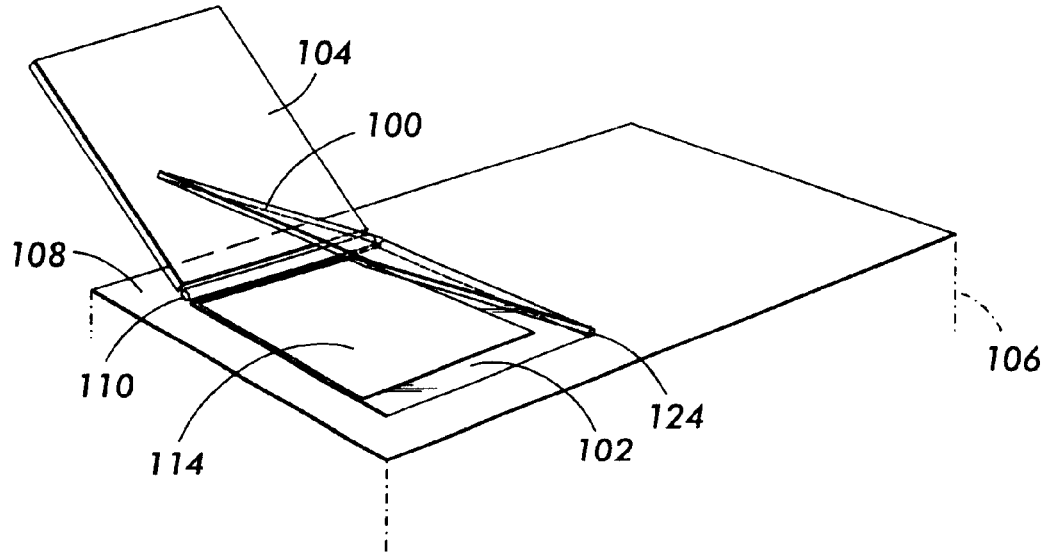
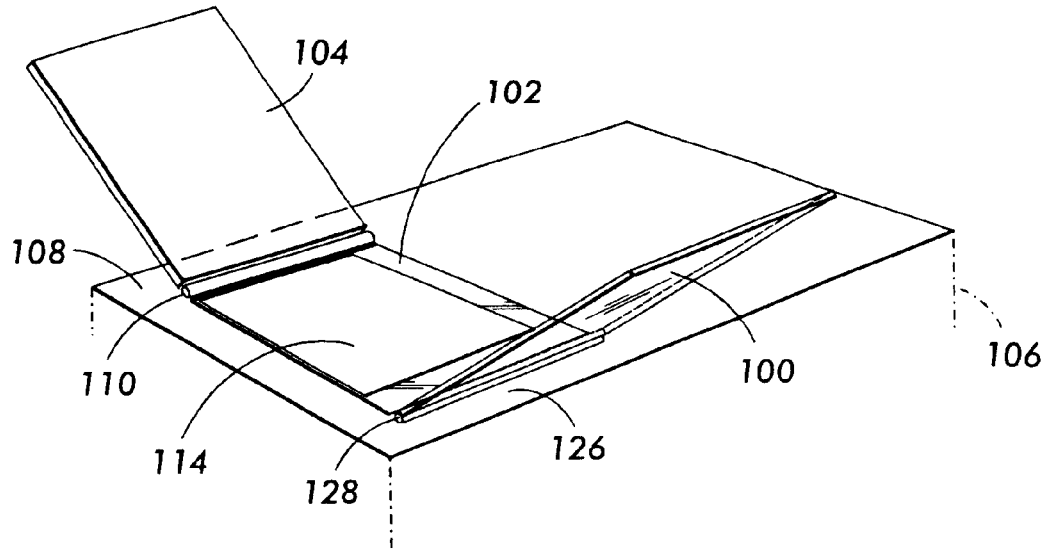
FIG. 6

FIG. 7
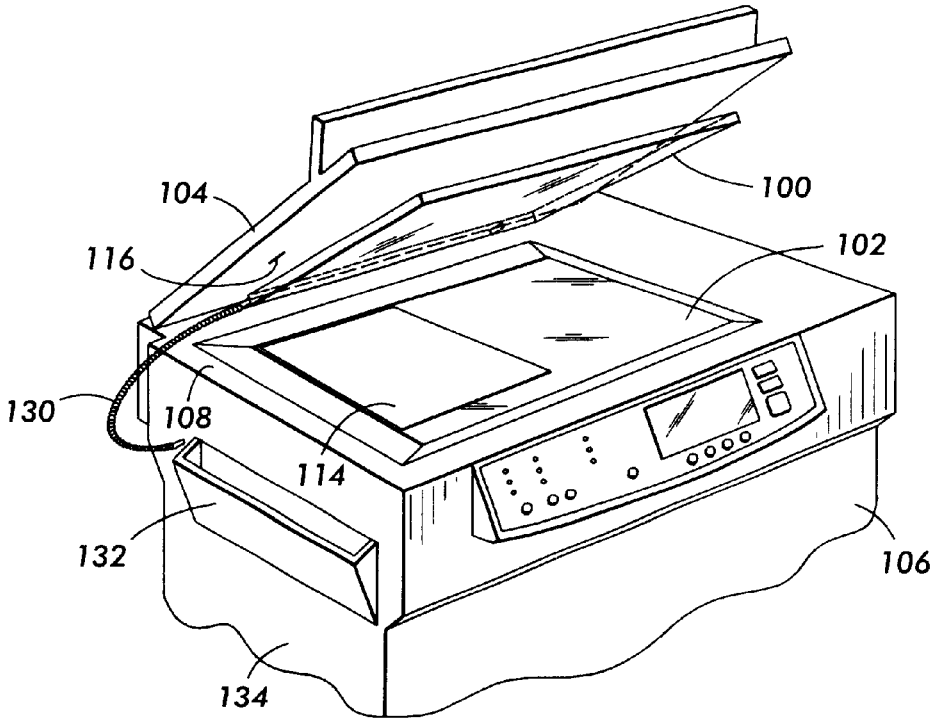
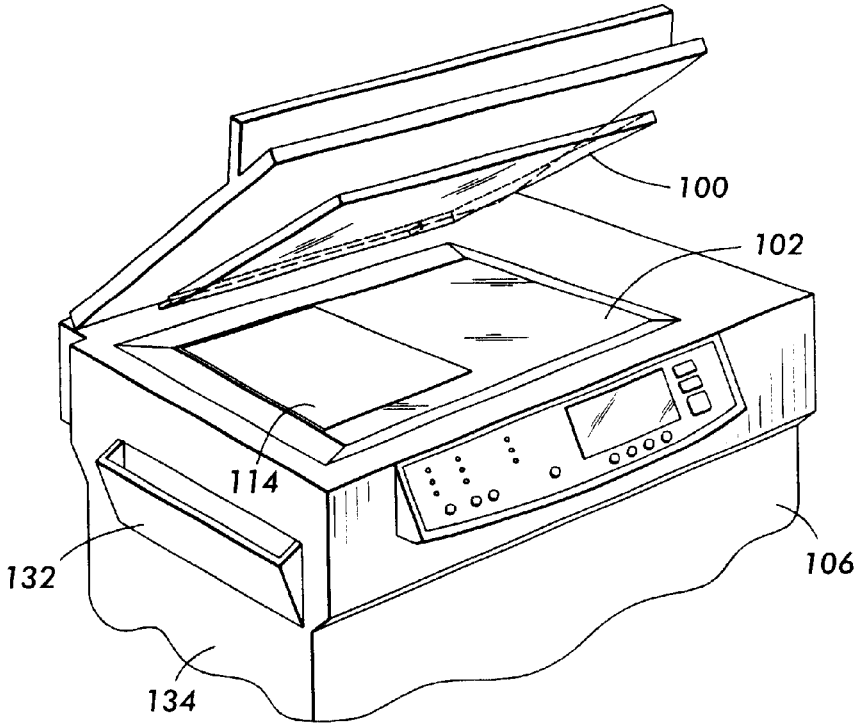
FIG. 8

INTERMEDIATE TRANSPARENT DOCUMENT HOLDER COVER FOR PHOTOCOPYING MACHINE PLATEN

BACKGROUND OF THE INVENTION

The present invention relates to a platen and platen cover of a photocopying machine and, more particularly to an intermediate transparent cover to prevent displacement of an original document on the platen.

A typical photographic copying machine is provided with a transparent platen which supports an original document during a copying process. The transparent platen allows graphic information on the original document to be scanned by an optical system within the copying machine. A scanning system then projects an image of the graphic information to a photoconductive member thereby creating a latent electrostatic image of the graphic information on the photoconductive member. The latent electrostatic image is developed on the photoconductive member by the application of colored marking material, which is transferred to another support material, usually plain paper, to form a photocopy of the graphic information on the original document.

The original document is illuminated by a source of high intensity light for photocopying. Typical techniques for illuminating the original document are scanning, which involves a relative movement between the original document and the source of illumination, or by a full-frame high Intensity flash exposure of the original document while both the original document and the light source remain stationary, even though the photoconductive member may be moving at the instant of the flash of illumination.

An original document is placed face down on the transparent platen to be copied or scanned by illumination from within the copy machine. A platen cover is pivotably mounted by a suitable hinge system adjacent to the platen to be swung down to a position covering the platen and to be swung up to an open position for placement of the original document on the platen or removal of the original document from the platen.

The platen cover holds and secures the original document on the platen. The platen cover typically has a white lower surface to provide a white background for a photocopy of an original document that does not fill the platen area to prevent black framing in copies of less than full-size originals.

When the original document is positioned on the platen and the platen cover is being lowered to close, air currents caused by the closing of the platen cover frequently cause the original document to be displaced, often resulting in off-center copying. This problem is exacerbated with small or light-weight documents or with multiple documents that have to be precisely positioned relative to each other on the platen.

The heavy electric current used in a present day copying machine and the resulting electric fields coupled with the extensive use of glass and plastics in the platen and platen cover creates electrostatic charges on the platen or the platen cover or both. These electrostatic charges also cause the original document on the platen to be displaced during closing of the platen cover.

It is an object of this invention to provide a platen cover to prevent displacement of an original document.

SUMMARY OF THE INVENTION

According to the present invention, an intermediate platen cover is provided between a platen and a platen cover of a photocopying machine to prevent displacement of a document on the platen. The intermediate platen cover is transparent to allow the user to see placement of the document and to not interfere with the background lower surface of the platen cover during photocopying. The intermediate platen cover can be hinged with the platen cover or attached along any of the sides around the platen. The intermediate platen cover can be tethered to the photocopying machine or freestanding. The upper surface of the intermediate platen cover can be repositionably adhesive to help attach and position the document to the intermediate platen cover before lowering into position on the platen.

Other objects and attainments together with a fuller understanding of the invention will become apparent and appreciated by referring to the following description and claims taken in conjunction with the accompanying drawings.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

FIG. 1 is a perspective view of an intermediate platen cover between a platen and platen cover of a photocopying machine of the present invention.

FIG. 2 is a side view of the intermediate platen cover between the platen and platen cover of the photocopying machine of FIG. 1.

FIG. 5 is a perspective view of a platen side attachment of an intermediate platen cover of a photocopying machine.

FIG. 6 is a perspective view of a platen front attachment of an intermediate platen cover of a photocopying machine.

FIG. 7 is a perspective view of an intermediate platen cover connected by a tether between a platen and platen cover of a photocopying machine.

FIG. 8 is a perspective view of a freestanding intermediate platen cover between the platen and platen cover of a photocopying machine.

DESCRIPTION OF THE INVENTION

Figure 3:
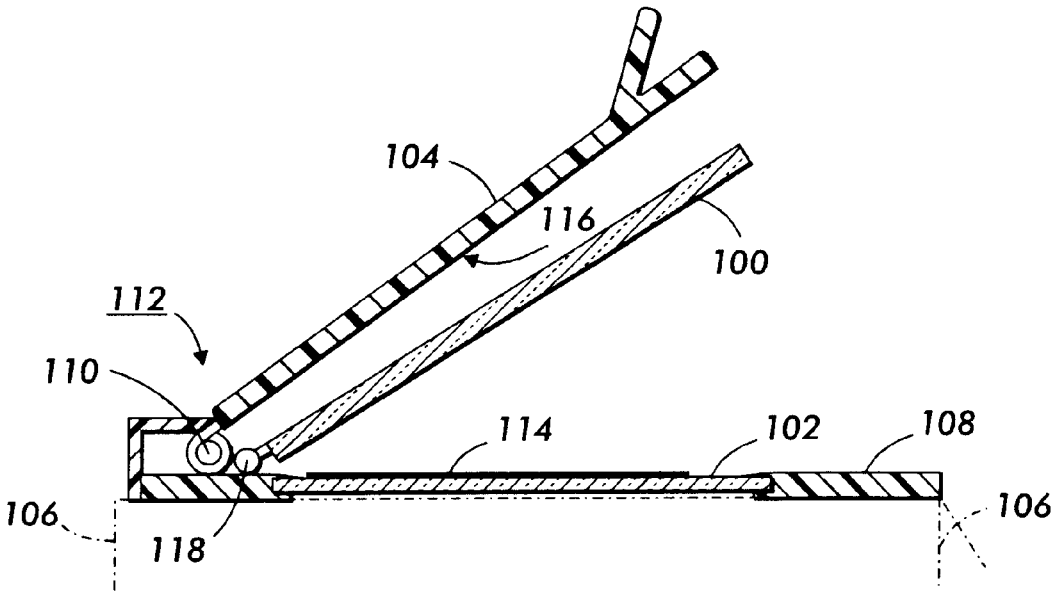
FIG. 3 is a side view of an alternate hinging means for an intermediate platen cover between a platen and platen cover of a photocopying machine.

In the following detailed description, numeric ranges are provided for various aspects of the embodiments described. These recited ranges are to be treated as examples only, and are not intended to limit the scope of the claims hereof. In addition, a number of materials are identified as suitable for various facets of the embodiments. These recited materials are to be treated as exemplary, and are not intended to limit the scope of the claims hereof.

Reference is now made to FIGS. 1 and 2, wherein there is illustrated an intermediate transparent platen cover 100 between a platen 102 and platen cover 104 of a photocopying machine 106 in accordance with the invention.

The photocopying machine 106 provides a rectangular platen 102 on the top surface 108 of the machine 106. The generally rigid, generally rectangular platen cover 104 is attached with hinges 110 to the top surface 108 of the machine 106 along the back side 112 of the machine 106 adjacent to the platen 102. The platen cover 104 pivots on the axis of the hinges 110 to swing down to cover the platen 102 and a document 114 on the platen 102 to be photocopied and to swing up to allow the document 114 on the platen 102 to be removed and a new document to be positioned on the platen 102. The rectangular platen cover 104 preferably has a surface area equal to or slightly larger than the surface area of the platen 102 (and the document 114 on the platen 102) so that when closed the platen cover 104 completely covers the platen 102.

The intermediate platen cover 100 is located between the platen 102 and platen cover 104 of the photocopying machine 106. The intermediate platen cover 104 can be rigid or flexible and may comprise any of a wide range of transparent, plate-like materials, such as glass, plastic, acrylic or other material suitable for the intended application.

The intermediate platen cover 100 in FIGS. 1 and 2 is attached with the same hinges 110 as the platen cover 104 to the top surface 108 of the machine 106 along the back side 112 of the platen 102. The intermediate platen cover 100 pivots on the axis of the hinges 110 to swing down to cover the platen 102 and a document 114 on the platen 102 to be photocopied and to swing up to allow the document 114 on the platen 102 to be removed and a new document (not shown) to be positioned on the platen 102.

In operation with both the intermediate platen cover 100 and the platen cover 104 open, an original document 114 to be photocopied is positioned on the platen 102. The intermediate platen cover 100 is swung down to cover the document 114 on the platen 102. The intermediate platen cover 100 is transparent to visible wavelength. This transparency allows the user to see the document 114 positioned on the platen 102. The intermediate platen cover 100 can be raised and the document 114 repositioned on the platen 102, if necessary. The intermediate platen cover 100 also secures the document 114 into close contact with the platen 102 to obtain a better photocopy. The platen cover 104 is then swung down to cover and secure the intermediate platen cover 100.

The intermediate platen cover 100 preferably has a surface area equal to or slightly larger than the surface area of the platen 102 (and the document 114 on the platen 102) so that when closed the intermediate platen cover 100 completely covers the platen 102. The intermediate platen cover 100 preferably has a surface area equal to or slightly smaller than the surface area of the platen cover 104 so that when the platen cover 104 is closed, the platen cover 104 completely coven the transparent intermediate platen cover 100 preventing any light leakage from the photocopying machine 106 during operation.

The intermediate platen cover 100 is also transparent to the scanning light beam or the full-frame light flash of the photocopying machine 106. This transparency allows light from the platen 102 to be transmitted through the intermediate platen cover 100 to the white background on the lower surface 116 of the platen cover 104 and allows the reflected light to be transmitted back through the intermediate platen cover 100 through the transparent platen 102 to the scanning system within the photocopying machine 106. The intermediate platen cover 102 will not optically interfere with the platen cover 104 providing a white background for a photocopy of a document 114 that does not fill the platen area to prevent black framing in copies of less than full-size original documents.

The platen cover 104, then the intermediate platen cover 100 are swung up to an open position to allow the document 114 to be removed from the platen 102 and any new documents (not shown) to be positioned on the platen 102.

As shown in FIGS. 1 and 2, the intermediate platen cover 100 can be pivotably attached to the photocopy machine 106 by the same hinges 110 as the platen cover 102. Alternately, as seen in FIG. 3, the intermediate platen cover 100 can be secured by a separate hinging means 118, Velcro, mechanical fasteners or some other suitable restraining means that provides for the necessary pivoting for closing and opening of the intermediate platen cover 100 on the platen 102. The separate hinges 118 would be positioned on the back side 112 of the machine 106 between the platen cover hinges 110 and the platen 102.

Figure 4:
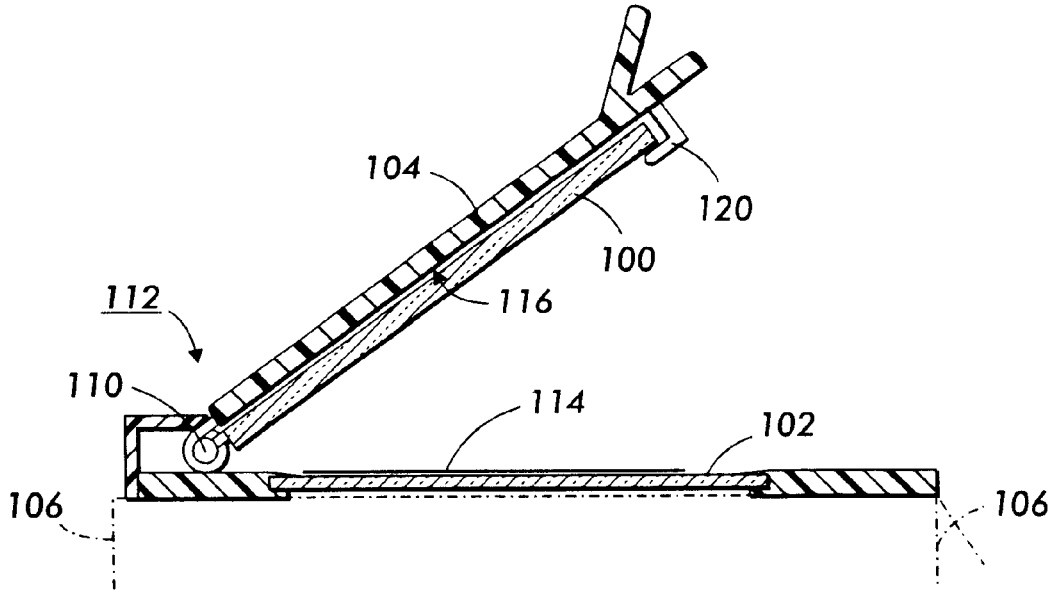
FIG. 4 is a side view of the attachment for an intermediate platen cover to a platen cover of a photocopying machine.

If the intermediate platen cover 100 and the platen cover 104 move along the same pivot axis as in FIGS. 1 and 2 or along parallel pivot axes as in FIG. 3, the intermediate platen cover 100 can be removable attached by latches 120 to the lower surface 116 of the platen cover 104 when not in use as shown in FIG. 4.

The intermediate platen cover 100 can be pivotably attached on either side of the machine 106 by hinge 124 adjacent to the platen 102 as shown in FIG. 5 or on the front side 126 of the machine 106 by hinge 128 adjacent to the platen 102 as shown in FIG. 6, provided the intermediate platen cover 100 has sufficient clearance to be raised and lowered when the platen cover 104 is open and provided the intermediate platen cover 100 does not interfere with the raising and lowering of the platen cover 104. By pivotably attaching the intermediate platen cover 100 on a pivot axis different from the platen cover pivot axis, the intermediate platen cover 100 need not be between the platen 102 and the platen cover 104 when the intermediate platen cover 100 is not in use during photocopying.

The intermediate platen cover 100 need not be pivotably attached adjacent to the platen 102. The intermediate platen cover 100 of FIG. 7 is attached by a tether 130 to the photocopying machine 106.

In operation with the intermediate platen cover 100 of FIG. 7 positioned away from the platen 102 and the platen cover 104 open, an original document 114 to be photocopied is positioned on the platen 102. The intermediate platen cover 100 is moved into position to cover the document 114 on the platen 102. The intermediate platen cover 100 can be raised and the document 114 repositioned on the platen 102, if necessary. The intermediate platen cover 100 also secures the document 114 into close contact with the platen 102 to obtain a better photocopy. The platen cover 104 is then lowered to cover and secure the intermediate platen cover 100.

After photocopying, the platen cover 104 is swung up to an open position, then the intermediate platen cover 100 is moved away to allow the document 114 to be removed from the platen 102 and any new documents (not shown) to be positioned on the platen 102.

When not in operation, the intermediate platen cover 100 can be stored in a compartment 132 on the side 134 of the photocopying machine 106.

The intermediate platen cover 100 need not be attached to the photocopying machine 106. A freestanding intermediate platen cover 100 is shown in FIG. 8.

Similar to the tethered intermediate platen cover 100 of FIG. 7, in operation with the intermediate platen cover 100 of FIG. 8 positioned away from the platen 102 and the platen cover 104 open, an original document 114 to be photocopied is positioned on the platen 102. The intermediate platen cover 100 is moved into position to cover the document 114 on the platen 102. The intermediate platen cover 100 can be raised and the document 114 repositioned on the platen 102, if necessary. The intermediate platen cover 100 also secures the document 114 into close contact with the platen 102 to obtain a better photocopy. The platen cover 104 is then lowered to cover and secure the intermediate platen cover 100.

After photocopying the platen cover 104 is swung up to an open position, then the intermediate platen cover 100 is moved away to allow the document 114 to be removed from the platen 102 and any new documents (not shown) to be positioned on the platen.

When not in operation, the intermediate platen cover 100 can be stored in a compartment 132 on the side 134 of the photocopying machine 106.

Figure 9:
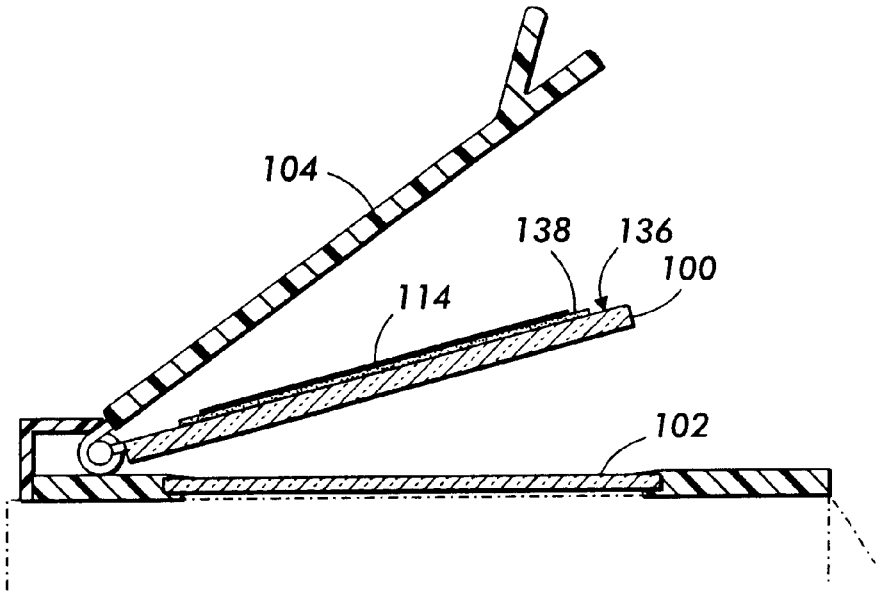
FIG. 9 is a side view of a document attached by a repositionable adhesive to an upper surface of an intermediate platen cover of a photocopying machine.

The upper surface 136 of the intermediate platen cover 100 of FIG. 9, the surface adjacent to the platen cover 104, can have a repositionable adhesive coating 138 or a slight electrostatic charge so that the document 114 can be attached and held in position on the upper surface 136 of the intermediate platen cover 100 when open. The intermediate platen cover 100 can be lowered into position on the platen 102 thus positioning the document 114 on the platen 102. After scanning, the intermediate platen cover 100 can be raised and the document 114 e removed from the upper surface 136.

The adhesive coating 138 can be a repositionable adhesive, commercially available from 3M. The adhesive coating 138 should be transparent to visible wavelengths to allow the user to see positioning of the document 114 through the intermediate platen cover 100 and the adhesive coating 138 on the platen 102. The adhesive coating 138 should also be transparent to the wavelength of the scanning light beam or the full-frame light flash of the photocopying machine 106. The adhesive coating 138 should also not chemically react or discolor the platen 102, intermediate platen cover 104 or the document 114 itself. The adhesive coating 138 should not adhere to the platen 102 or permanently adhere to the document 114.

Figure 10:
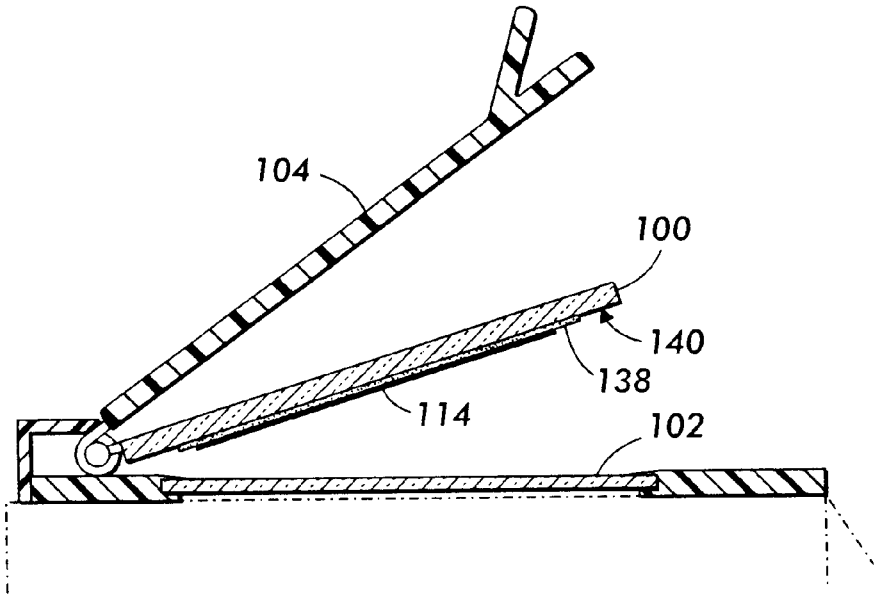
FIG. 10 is a side view of a document attached by a repositionable adhesive to a lower surface of an intermediate platen cover of a photocopying machine.

As shown in FIG. 10, the repositionable adhesive 138 can be coating on the lower surface 140 of the intermediate platen cover 100. The document 114 can be attached by the adhesive coating 138 to the lower surface 140 and held in position on the lower surface 140 of the intermediate platen cover 100 when open. The intermediate platen cover 100 can be lowered into position on the platen 102 thus positioning the document 114 on the platen 102. After scanning, the intermediate platen cover 100 can be raised and the document 114 removed from the lower surface 140.

Figure 11:
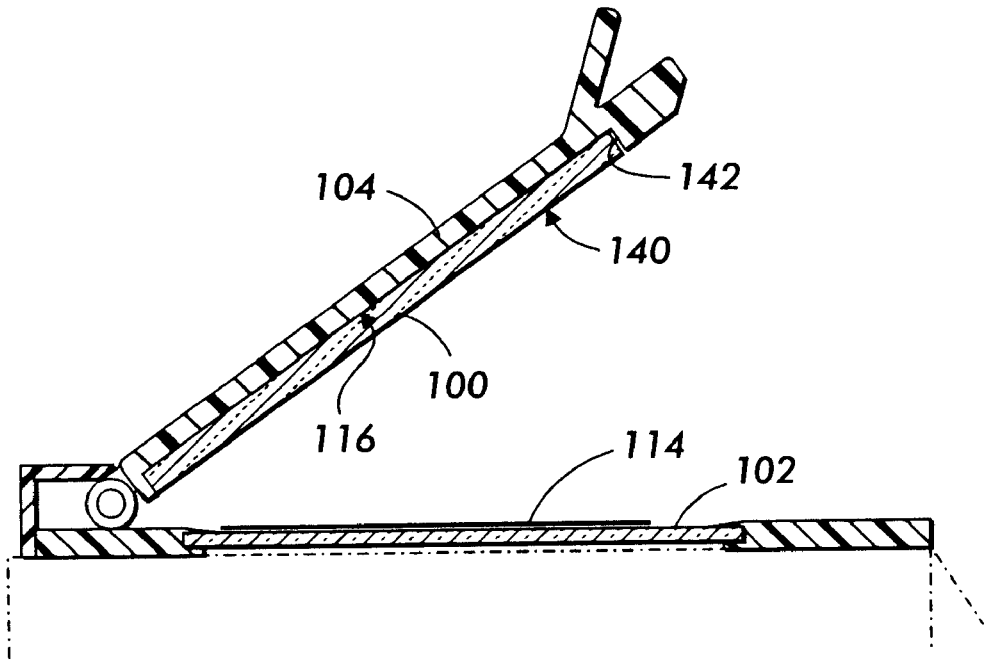
FIG. 11 is a side view of an intermediate platen cover fitting within a recess in a platen cover between a platen and platen cover of a photocopying machine of the present invention.

The intermediate platen cover 100, as shown in FIG. 11, can fit within a recess 142 in the lower surface 116 of the platen cover 104. The recess 142 provides a single smooth surface, the lower surface 140 of the intermediate platen cover 100, against the platen 102, rather than the stack of platen cover on intermediate platen cover 104 on platen 102.

With the appropriate slots (not shown) in the platen cover 102 for the hinges 110 or hinging means 118 or attaching means of the intermediate platen cover 100, the intermediate platen cover 100 will fit in the recess 142 during use of the intermediate platen cover 100 and the platen cover 104. The intermediate platen cover 100 can be removably attached within the recess 142 as shown in FIG. 11 by latches to the lower surface 116 of the platen cover 104 as shown in FIG. 4.

If the platen 102 is a reciprocating or moving platen, then the intermediate platen cover 100 should be attached to the body of the reciprocating platen so that the intermediate platen cover 100 moves with the platen 102 holding the document 114 in position.

While the invention has been described in conjunction with specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. An apparatus for preventing displacement of a document on a photocopying machine comprising:

a platen, said document being positioned on said platen for photocopying;

a transparent intermediate platen cover, said transparent intermediate platen cover securing said document to said platen, said document being visible through said transparent intermediate platen cover to show any displacement of said document on said platen; and a platen cover, said platen cover securing said transparent intermediate platen cover to said platen, the lower surface of said platen cover being visible through said transparent intermediate platen cover to provide a background for said document during photocopying wherein said intermediate transparent platen cover has the same pivoting means as said platen cover and said transparent intermediate platen cover can be removably attached to said platen cover.

2. The apparatus for preventing displacement of a document on a photocopying machine of claim 1 wherein said transparent intermediate platen cover fits within a recess in the lower surface of said platen cover.

3. The apparatus for preventing displacement of a document on a photocopying machine of claim 2 wherein said transparent intermediate platen cover can be removably attached to said platen cover.

4. The apparatus for preventing displacement of a document on a photocopying machine of claim 1 wherein said transparent intermediate platen cover has a first pivoting means and said platen cover has a second pivoting means, said second pivoting means being different from said first pivoting means.

5. The apparatus for preventing displacement of a document on a photocopying machine of claim 4 wherein said transparent intermediate platen cover can be removably attached to said platen cover.

6. The apparatus for preventing displacement of a document on a photocopying machine of claim 4 wherein said transparent intermediate platen cover fits within a recess in the lower surface said platen cover.

7. The apparatus for preventing displacement of a document on a photocopying machine of claim 6 wherein said transparent intermediate platen cover can be removably attached to said platen cover.

8. The apparatus for preventing displacement of a document on a photocopying machine of claim 1 wherein said transparent intermediate platen cover is tethered to said photocopying machine.

9. The apparatus for preventing displacement of a document on a photocopying machine of claim 1 wherein said transparent intermediate platen cover is freestanding from said photocopying machine.

10. The apparatus for preventing displacement of a document on a photocopying machine of claim 1 wherein said document can repositionably adhere to a surface of said transparent intermediate platen cover.

11. The apparatus for preventing displacement of a document on a photocopying machine of claim 10 wherein said document can repositionably adhere to the upper surface of said transparent intermediate platen cover.

12. The apparatus for preventing displacement of a document on a photocopying machine of claim 10 wherein said document can repositionably adhere to the lower surface of said transparent intermediate platen cover.

13. The apparatus for preventing displacement of a document on a photocopying machine of claim 1 wherein said transparent intermediate platen cover fits within a recess in the lower surface of said platen cover.

* * * * *